US006725465B2

(12) United States Patent
Taylor

(10) Patent No.: US 6,725,465 B2
(45) Date of Patent: Apr. 27, 2004

(54) INTERLOCKING GRIP GLOVE

(76) Inventor: Kip P. Taylor, 1668 N. Oakridge Park Dr., Farmington, UT (US) 84025

( * ) Notice: Subject to any disclaimer, the term of this patent is extended or adjusted under 35 U.S.C. 154(b) by 0 days.

(21) Appl. No.: 10/082,851

(22) Filed: Feb. 25, 2002

(65) Prior Publication Data

US 2002/0116745 A1 Aug. 29, 2002

Related U.S. Application Data

(60) Provisional application No. 60/271,863, filed on Feb. 27, 2001, and provisional application No. 60/271,864, filed on Feb. 27, 2001.

(51) Int. Cl.[7] ..... A41D 19/00
(52) U.S. Cl. ..... 2/161.1; 2/163
(58) Field of Search ..... 2/159, 160, 161.1, 2/163, 158, 161.2, 161.3, 161.6, 16–21, 167, 170, 910, 917; 128/878, 879, 880; 602/21, 22; 473/205, 300, 451, 458, 464; 482/44, 48; 273/317.2, 317.3, 317.4, 317.5, 317.6

(56) References Cited

U.S. PATENT DOCUMENTS

| | | | | | |
|---|---|---|---|---|---|
| 2,782,422 | A | * | 2/1957 | Bencriscutto | 2/161 |
| 3,930,271 | A | * | 1/1976 | Kahng | 2/161.4 |
| 5,018,221 | A | * | 5/1991 | Romandetto | 128/878 |
| 5,592,695 | A | * | 1/1997 | Roche | 2/160 |
| 5,669,073 | A | * | 9/1997 | Pellington | 2/160 |
| 5,898,943 | A | | 5/1999 | Kim | 2/161.2 |
| 6,212,687 | B1 | * | 4/2001 | Kwon | 2/161.3 |
| 6,279,164 | B1 | | 8/2001 | Martin | 2/161.1 |

* cited by examiner

*Primary Examiner*—Tejash Patel
(74) *Attorney, Agent, or Firm*—Kunzler & Associates

(57) ABSTRACT

A restraining loop attached to the outer peripheral edge of the index finger of a glove provides support for the little finger of the opposite hand inserted into the restraining loop. When wearing the glove, the golfer is prevented from shifting his hands while gripping the golf club and the proper alignment of the golfer's knuckles is maintained throughout the entire swing. The glove may also be used for baseball and other uses.

20 Claims, 7 Drawing Sheets

INTERLOCKING GRIP GLOVE

RELATED APPLICATIONS

This application is entitled to benefit of provisional patent applications Serial No. 60/271,863 and Serial No. 60/271,864 both filed on Feb. 27, 2001.

BACKGROUND OF THE INVENTION

1. The Field of the Invention

The present invention relates to gloves worn to retain the hands in a desired relationship. More specifically, the invention relates to a glove that holds one hand in a desired position with respect to the other hand.

2. The Relevant Art

Golf gloves are generally made of a leather material in order to protect the skin of the hand that holds the golf club and to allow the glove conform to a golf club or other handle. Such gloves are often equipped with a pad to protect the palm of the hand and a leather strap to fasten the glove around the wrist.

In the game of golf, a good grip on the club is one of the most vital aspects of the game. The ultimate success or failure of a golf swing begins with the grip. If the grip is bad, the shot will suffer. Many teaching pros consider a poor grip to be the reason for the vast majority of bad golf swings. A golf glove can improve the grip by preventing moisture from the hands from ever making it to the club. With the use of a glove, the club's grip stays dry does not slip from the hands during the swing. This allows the golfer to use a lighter grip on the club, which is recommended for the most effective swing. Some of today's more advanced golf gloves also come with a tacky material on the palm that improves the grip throughout the swing.

In addition to improving the grip, a golf glove protects and keeps the hands comfortable through a full 18 holes or a bucket of balls at the driving range. The act of striking a golf ball causes many vibrations throughout the shaft of the club. This vibration is transferred directly to the hands, which in turn transfer it to the wrists, forearms, and shoulders. A glove can help absorb some of this vibration, which not only leads to healthier hands, but also to less fatigued muscles throughout the upper body. If one plays for an extended period of time, the repeated impact of hitting the ball can take its toll on the hands. Left unprotected, blisters and muscle tenderness can develop. This can have a very negative effect on a game, since tired, sore hands are not conducive to a good grip. A good golf glove can help absorb much of the impact when you hit the ball, and can go a long way in protecting the hands.

Although golf gloves help improve the grip on a golf club, the fingers and palms of the hands may still shift during the motion of a golf swing. This may compromise the grip on the golf club. Ben Hogan, a well-known expert in the sport of golf, has stated the following, "Good golf begins with a good grip." The way the hands are placed on the golf club has a direct relationship to the flight of the ball. If the grip is too weak, the clubface angle at impact will be off line, which will cause the ball to curve. The bottom edge of the clubface needs to be straight to the target line in order for the ball to fly straight toward the target. A good golf grip would be considered neutral, that is, neither weak nor strong. A neutral grip will allow the hands to react properly to an aggressive swing.

Three types of grips are widely accepted. The first grip is the oldest of the group and is called the baseball grip. The baseball grip that was the first grip used in golf. It entails holding on to the club with two hands, one above the other, much like a baseball player would hold on to a baseball bat.

The second type of grips is called the Overlapping Grip. In this grip, players hold their hands much like the baseball grip, but the hands are placed together with the pinky finger of one hand on top of the left index finger of the other hand. This type of golf grip has become a major gripping style in part, at least, because it allows the player's hands to work in unison.

The final type of golf grip is called the interlocking grip. The interlocking grip is probably the most popular grip with professional and non-professional players alike. In this grip, instead of the right pinky finger overlapping the left index finger, the two fingers actually cross.

With either of the three grips described above, the success of the golf swing depends on the golfer's ability to avoid shifting or moving the hands during the motion of the golf swing. While the prior art discloses golf gloves that help maintain a steady and firm grip on a golf club, none of the previously known golf gloves provide a solution to maintaining proper finger and knuckle alignment. Accordingly, what is needed in the art is an improved golf glove that can be used to keep the hands of a golfer in the proper grip position through the entire golf swing.

OBJECTS AND BRIEF SUMMARY OF THE INVENTION

The golf glove of the present invention has been developed in response to the present state of the art, and in particular, in response to the problems and needs in the art that have not yet been fully solved by currently available golf gloves. Accordingly, it is an overall object of the present invention to provide a golf glove that overcomes many or all of the above-discussed shortcomings in the art.

To achieve the foregoing object, and in accordance with the invention as embodied and broadly described herein in the preferred embodiments, an improved golf glove is provided.

The golf glove of the present invention may be formed basically in the standard manner, having a thumb portion, a plurality of finger portions, a main hand portion, and a wrist portion. Golf gloves of the present invention that are used by either left or right-handed golfers are exact mirrors images of each other.

In addition, each golf glove of the present invention is also provided with a retaining portion for retaining one or more fingers of the opposite hand. In one embodiment, the retaining portion is a loop of material attached to the outer peripheral edge of the index finger portion of the glove. Thus, when the golfer correctly grips a golf club, the retaining loop along the peripheral edge of the golfer's index finger on one hand interlocks with the little finger of the opposite hand, thereby connecting the golfer's hands together in the proper relationship during the entire swing of the golf club.

Thus, the present invention provides a glove that eliminates the problem of a golfer or other sportsman shifting his hands while gripping and/or swinging, a golf club or handle.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
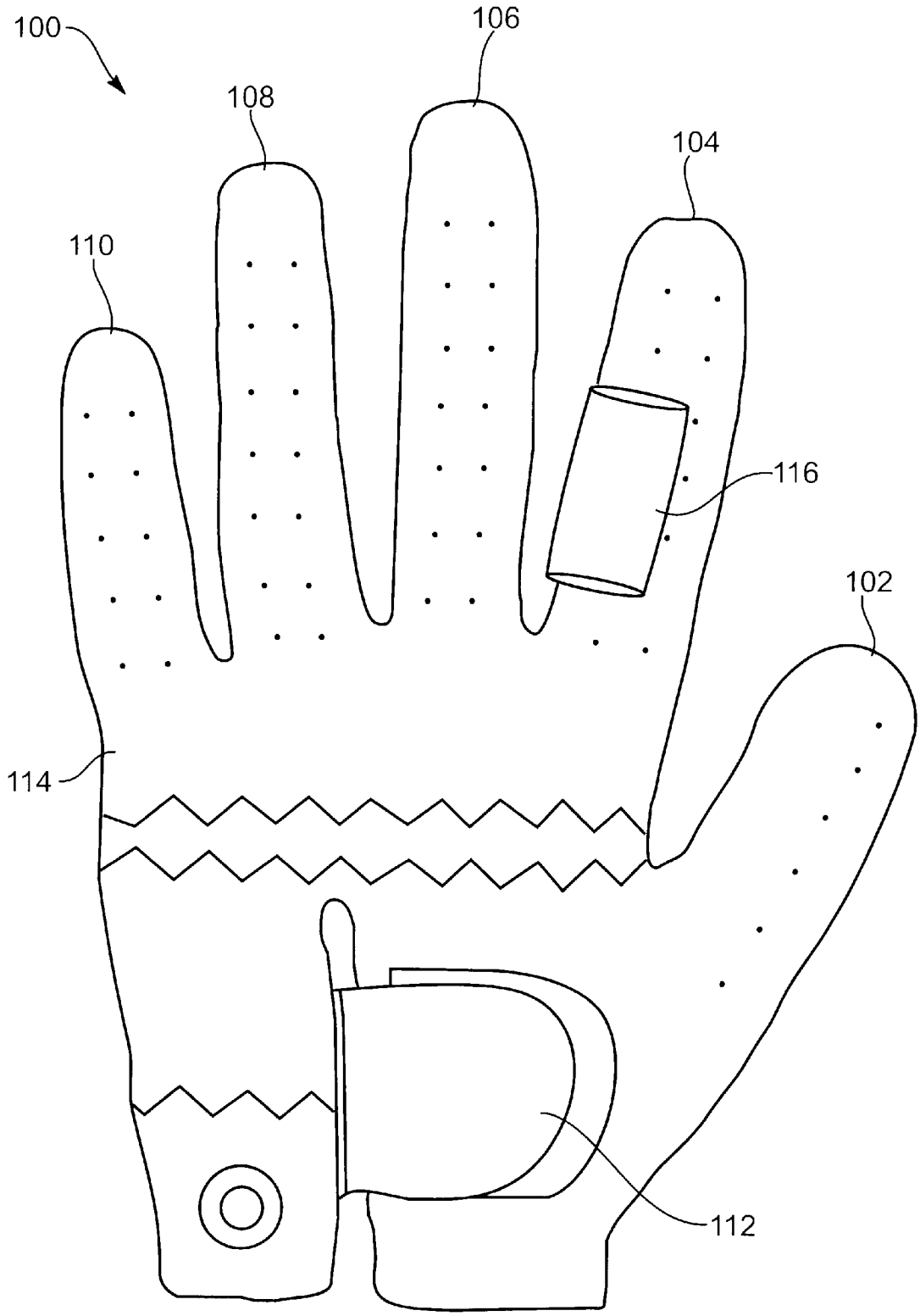
FIG. 1 is a rear view of a first embodiment of the golf glove of the present invention.

The present invention will be described by way of example herein with reference to a golf glove, though of course, the utility of the invention goes beyond the game of golf. FIG. 1 shows a rear view of the golf glove 100 of the present invention. The golf glove may be formed basically in the same manner as standard golf gloves. In the preferred embodiment, the glove 100 includes a thumb portion 102, an index finger portion 104, a middle finger portion 106, a ring finger portion 108, a small ("pinky") finger portion 110, a wrist portion 112, and a main glove portion 114 adapted for respectively receiving the thumb, index finger, middle finger, ring finger, little finger, wrist, and hand of a human being in the conventional manner. The thumb portion 102 and each finger portion 104, 106, 108, and 110 extend outwardly from the main glove portion 114. The wrist portion 112 attaches to the main glove portion 114 on the side of the glove 100 opposite the finger portions 102, 104, 106, 108, and 110.

In the preferred embodiment of the invention, the main glove portion 114, wrist portion 112, and individual finger portions 102, 104, 106, 108, and 110 are constructed from a leather, or leather-like material. Cabretta leather is used in the preferred embodiment of the present invention.

Figure 5:
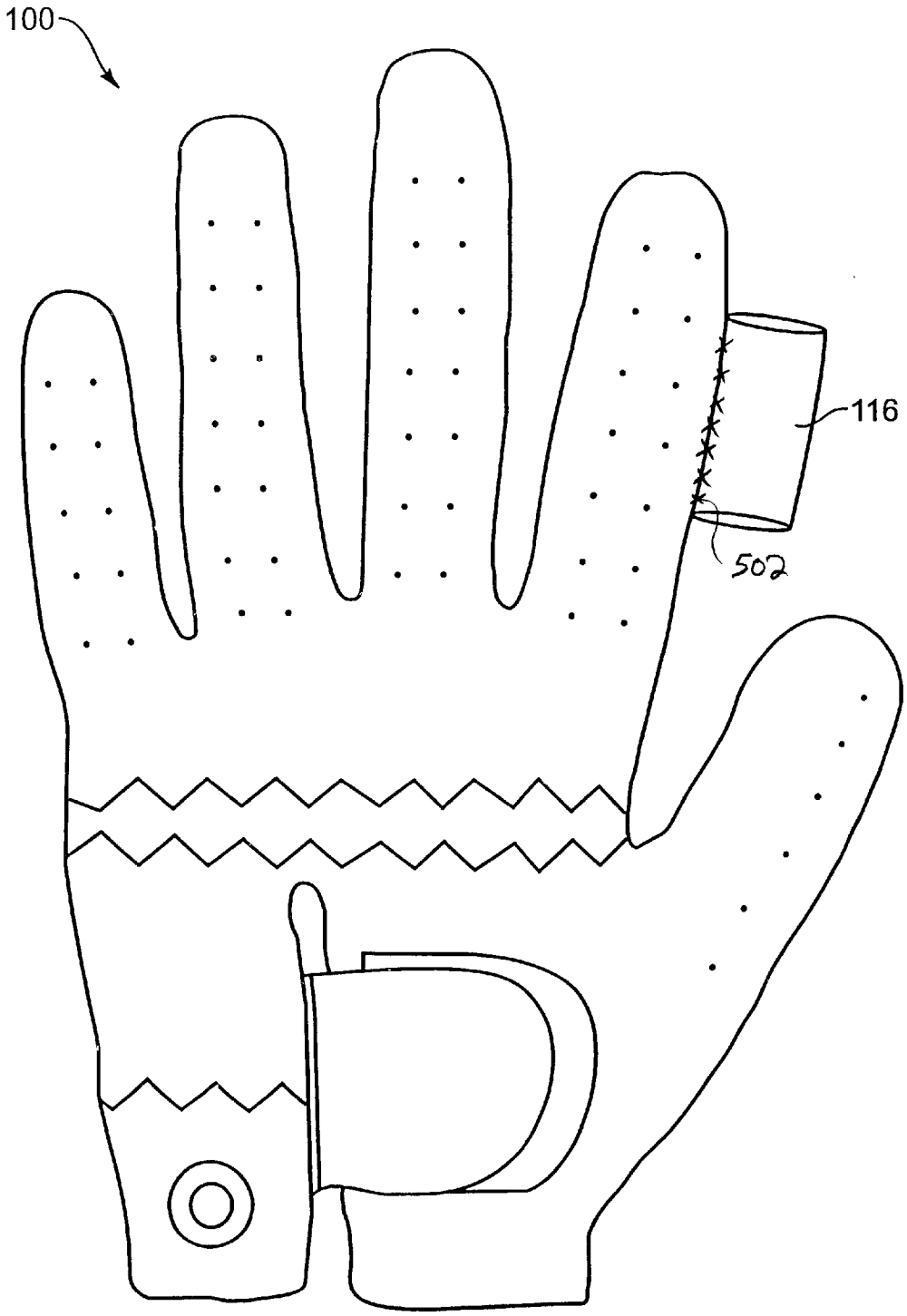
FIG. 5 is a rear view of a third embodiment of the golf glove of the present invention.
Figure 6:
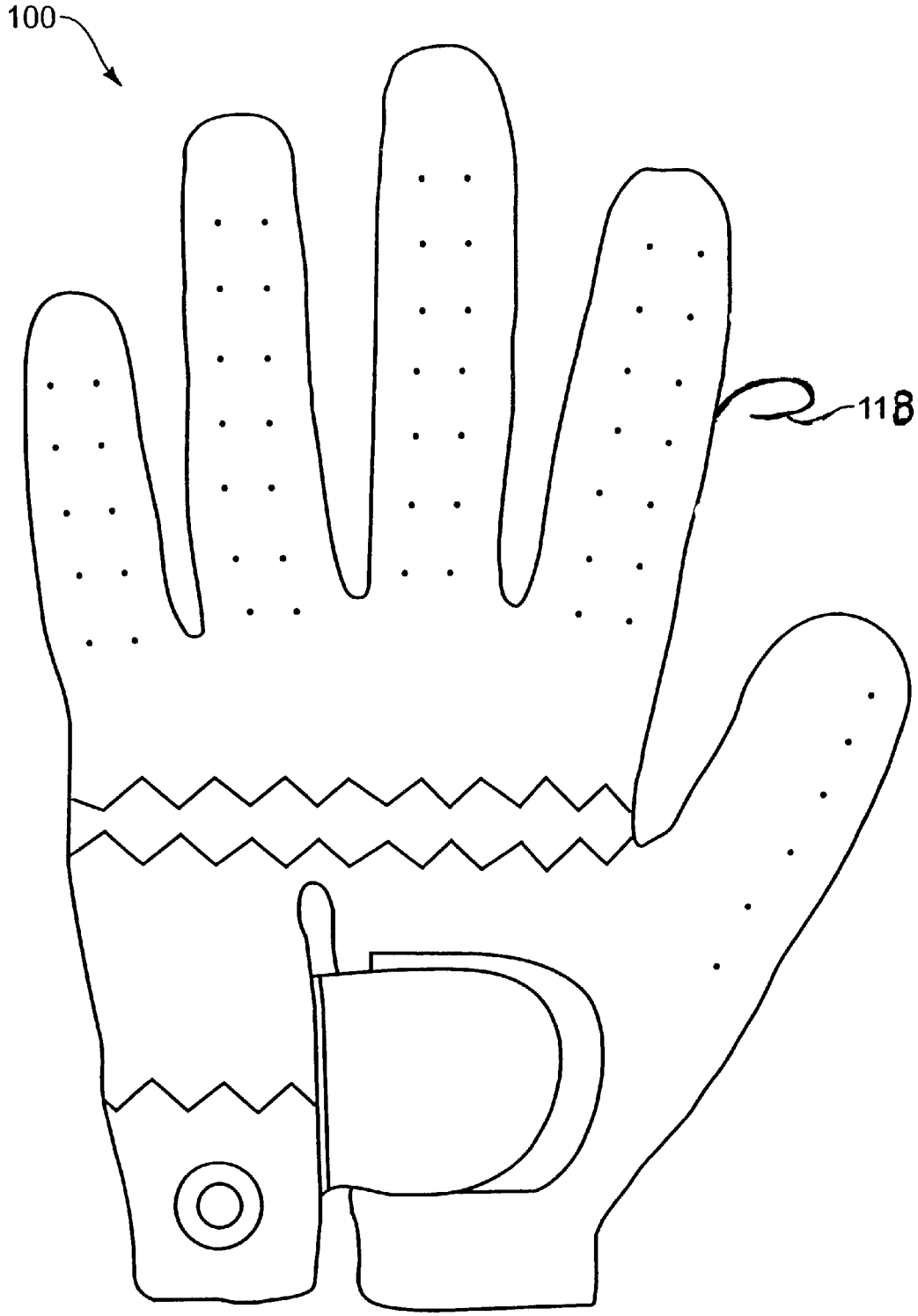
FIG. 6 is a rear view of a fourth embodiment of the golf glove of the present invention.

In addition to standard portions of the glove, a restraining portion is also added to one or more fingers of the glove 100. The restraining portion is adapted to at least partially restrain the hand not inserted into the glove from moving with respect to the hand that is inserted into the glove. In one embodiment, the restraining portion 116 is a loop of material fastened to a finger of the glove. In a second embodiment, the restraining portion 116 may also be sewn 502 to a finger of the glove 100 in FIG. 5. In FIG. 1, the loop is constructed of an elastic material and is attached on the top of the index finger 104 at a point between the two upper knuckles of the index finger 104. In one embodiment, the restraining portion is sewn into the index finger portion of the glove. Of course, the restraining device could be attached elsewhere to the glove, including to other fingers. Additionally, the restraining device may be a hook 118 as shown in FIG. 6, a ring, a loop of wire, or otherwise be configured to at least partially restrain the hand not inserted into the glove 100. The arrangement of FIG. 1 is suitable for the overlapping grip.

Figure 1A:
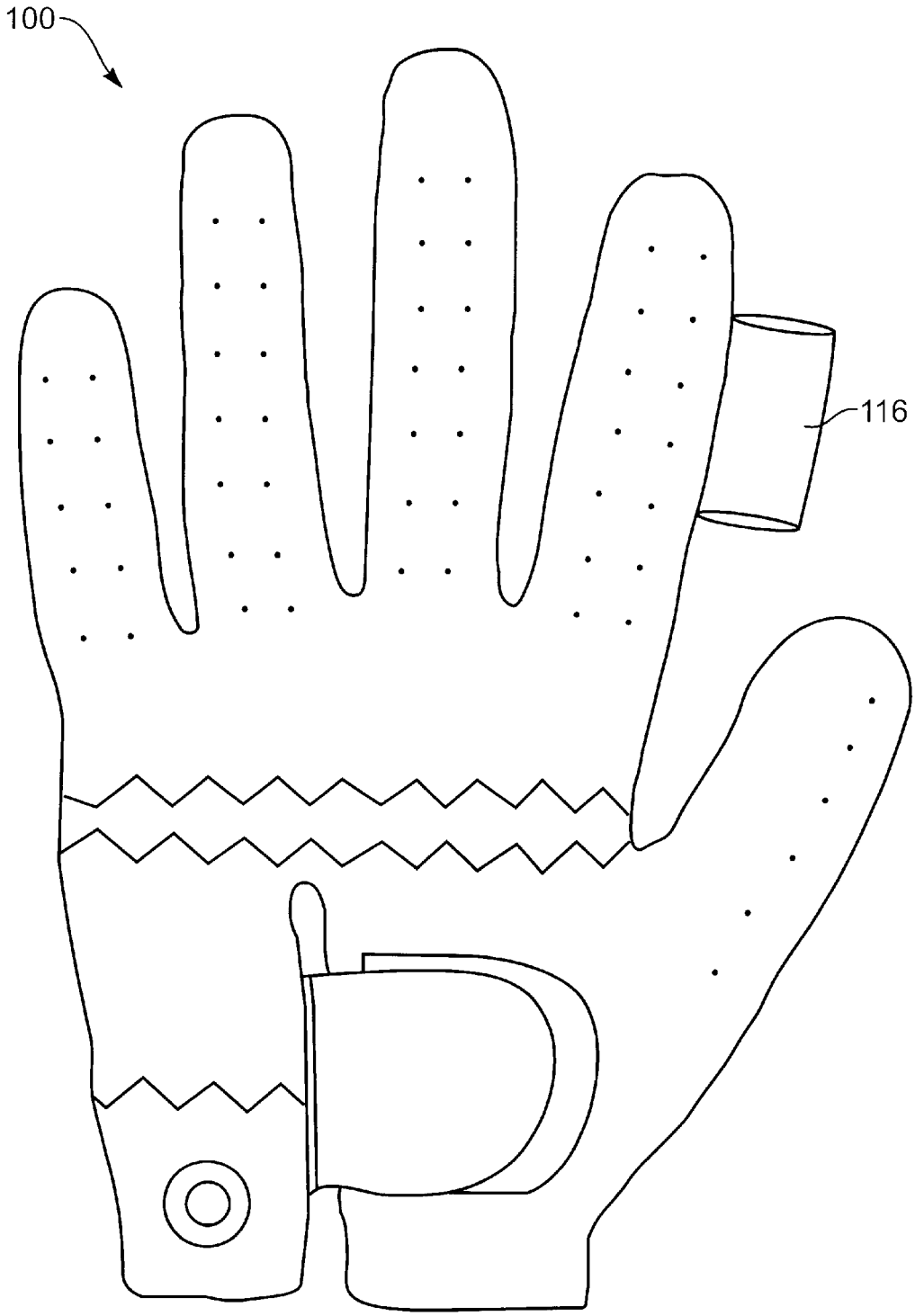
FIG. 1*a* is a rear view of a second embodiment of the golf glove of the present invention.

FIG. 1*a* shows a rear view of the glove 100 of the present invention. In the preferred embodiment, the glove 100 includes the same portions as described above for FIG. 1. The restraining portion 116 is shown attached to the side of the index finger 104. The placement of the restraining portion 116 in FIG. 1*a* is suitable for the "baseball grip" of the golf club. The restraining device may be placed between the index and middle finger for use with the interlocking grip.

Figure 2:
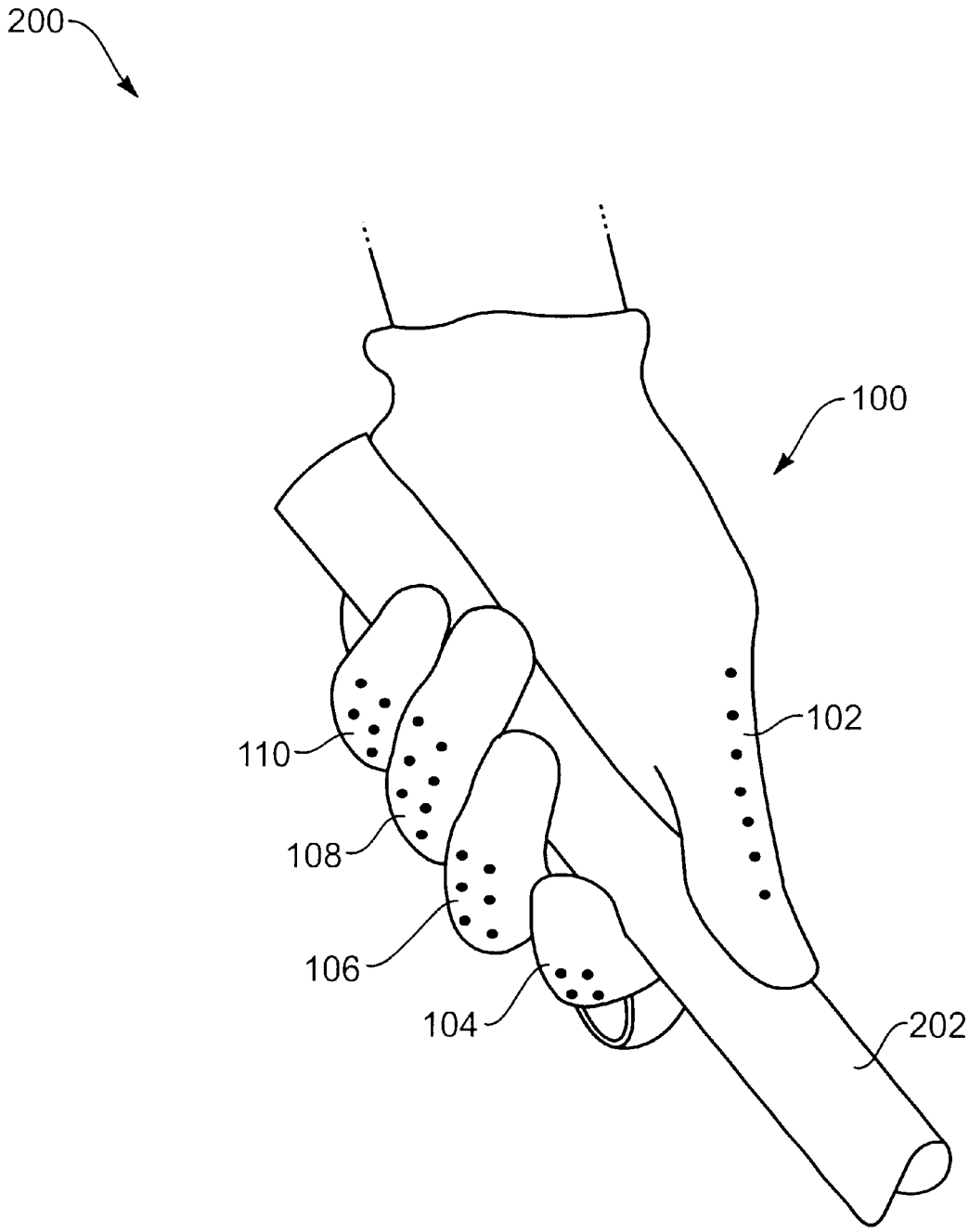
FIG. 2 is a side view of the golf glove of the present invention gripping the golf club.
Figure 3:
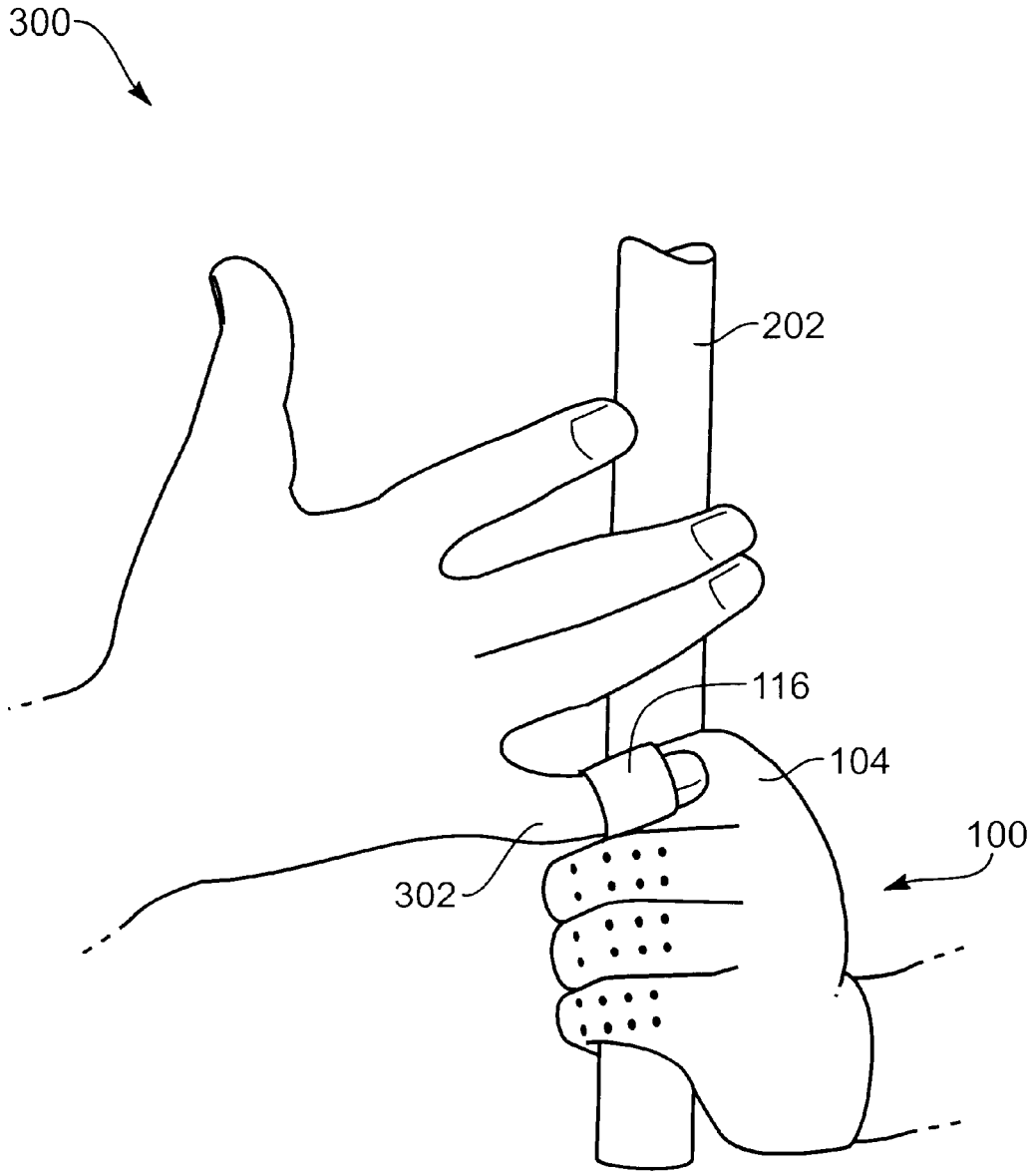
FIG. 3 is a front view illustrating a manner of interlocking of the little finger of the opposite hand into the restraining loop of the present invention.
Figure 4:
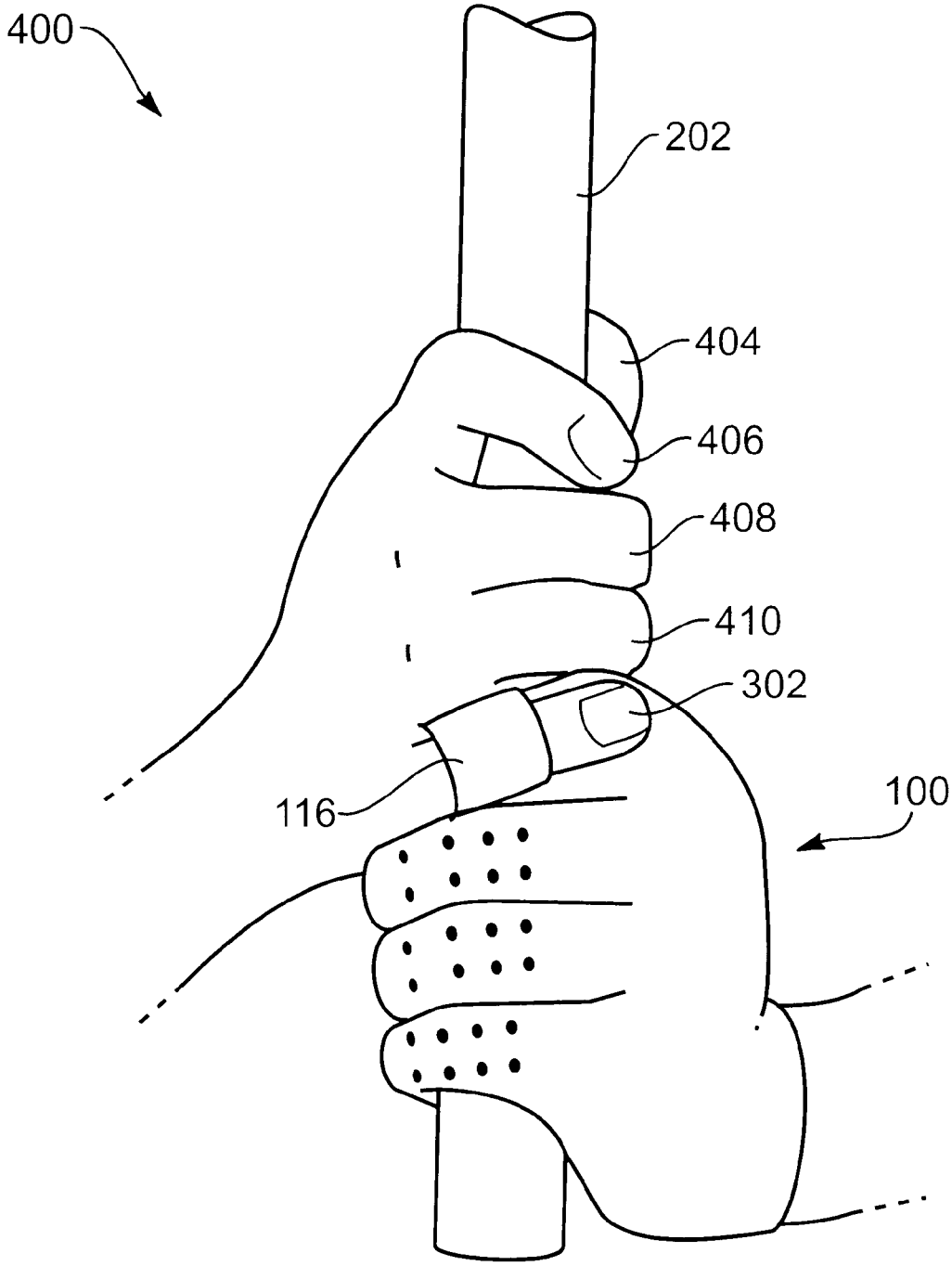
FIG. 4 is a front view illustrating the proper finished grip on the golf club.

FIGS. 2, 3, and 4 depict one embodiment 300 of a manner of properly interlocking the opposite hand 304 into the restraining loop 116 of the golf glove 100 of the present invention. Referring now to FIG. 2, a first hand of a golfer is inserted into a glove 100 of the present invention and is shown properly gripping the shaft of a golf club 202. The thumb portion 102 is placed parallel to the golf club 202. The finger portions 104, 106, 108, and 110 curl around the shaft of the club 202, forming a firm comfortable grip. This alignment of the index finger 104 allows the restraining portion 116 to be accessed by the opposite hand.

Referring now to FIG. 3, the clubhead is then placed on the ground behind the ball facing the target. The opposite hand grips the golf club 202 and the little finger 302 slides into the restraining portion 116 of the glove 100. Using the "baseball grip" the little finger 302 is placed to the side of the index finger 104 in the glove 100.

The overlapping grip is achieved by placing the hand in the glove 100. The opposite hand grips the golf club 202 and the little finger 302 slides into the restraining portion 116 of the glove 100. The little finger 302 is placed directly on top of the index finger 104 of the hand inserted into the glove 100.

FIG. 4 illustrates the final grip 400 that may be used with the golf glove 100 of the present invention. The little finger 302 of the opposite hand is interlocked into the restraining portion 116 as explained above for FIG. 3. The remaining fingers of the opposite hand 404, 406, 408, and 410 are curled around the shaft of the golf club 202, thus providing the golfer with a firm grip that maintains the two hands together. The golfer then swings and hits the ball with the hands maintaining their desired position throughout the entire swing.

It should be readily apparent that the glove of the present invention may be used for purposes other than golf. For instance, the glove may be used for activities, including baseball.

The present invention helps stabilize the grip throughout the swing, promoting solid ball striking and fewer missed hits. The present invention also forces the upper hand to roll over during the swing, helping to eliminate slicing. Thus, with both hands working as one, the invention significantly improves the mechanics of the golf swing. These advantages are achieved by the present invention in a manner that does not limit the flexibility of the golfer's fingers while using the device.

Children and adults (both male and female) alike can improve the form of their golf swing, thereby attaining greater accuracy in hitting and further distance on the golfball when using the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A glove comprising:

a wrist end portion;

a hand portion; and a thumb portion and finger portions, having a back side and a palm side, one of said finger portions having a restraining portion connected exclusively to a single finger portion between the two upper knuckles, for connecting with and at least partially restraining movement of a hand not in the glove.

2. The glove of claim 1, wherein the restraining portion comprises a loop for receiving a finger of the hand not in the glove.

3. The glove of claim 2, wherein the restraining portion comprises an elastic material.

4. The glove of claim 2, wherein the loop is adapted to receive the little finger of the hand not in the glove.

5. The glove of claim 2, wherein the restraining portion is sewn onto the index finger portion of the glove.

6. The glove of claim 1, wherein the restraining portion comprises a hook for receiving the finger of the hand not in the glove.

7. The restraining portion of claim 6, wherein the restraining portion is adapted to receive the little finger of the opposite hand.

8. The glove of claim 1, wherein the restraining portion is comprised of an elastic material and is sewn to the index finger portion of the glove, the restraining portion adapted to receive the little finger of the hand not in the glove.

9. The glove of claim 1, wherein said finger portion which is adapted to receive the index finger of said glove comprises an outer peripheral edge proximal to said thumb position, and the restraining portion is attached to said outer peripheral edge of the glove.

10. The glove of claim 1, wherein the thumb portion is separate and disconnected from the plurality of finger portions.

11. The glove of claim 1, wherein the restraining portion is connected to one side of a finger portion of the plurality of finger portions.

12. The glove of claim 1, wherein two sides of the restraining loop are connected to a single side of a finger portion of the plurality of finger portions.

13. A glove comprising:

a wrist end portion;

a hand portion; and a thumb portion and a plurality of finger portions, having a back side and a palm side;

a restraining loop connected exclusively to a single finger portion, for receiving a finger of the hand not in the glove;

the thumb portion being separate and free from any of said plurality of finger portions; and wherein the restraining loop is connected to one of a plurality of finger portions between the two upper knuckles.

14. A glove comprising:

a wrist end portion;

a hand portion; and a thumb portion and finger portions, having a back side and a palm side, one of said finger portions having a restraining portion connected exclusively to a single finger portion, for connecting with and at least partially restraining movement of a hand not in the glove, wherein the restraining portion comprises an elastic loop for receiving a finger of the hand not in the glove.

15. The glove of claim 14, wherein the loop is adapted to receive the little finger of the hand not in the glove.

16. The glove of claim 14, wherein the restraining portion is sewn onto the index finger portion of the glove.

17. The glove of claim 14, wherein said finger portion which is adapted to receive the index finger of said glove comprises an outer peripheral edge proximal to said thumb position, and the restraining portion is attached to said outer peripheral edge of the glove.

18. The glove of claim 14, wherein the restraining portion is attached at a point between the two upper knuckles of a finger portion of the plurality of finger portions.

19. The glove of claim 14, wherein the restraining portion is connected to one side of a finger portion of the plurality of finger portions.

20. The glove of claim 14, wherein two sides of the restraining loop are connected to a single side of a finger portion of the plurality of finger portions.

* * * * *

UNITED STATES PATENT AND TRADEMARK OFFICE

CERTIFICATE OF CORRECTION

PATENT NO. : 6,725,465 B2
DATED : April 27, 2004
INVENTOR(S) : Taylor

It is certified that error appears in the above-identified patent and that said Letters Patent is hereby corrected as shown below:

Column 1,
Line 18, “glove conform” should read -- glove to conform --.
Line 30, “dry does” should read -- dry and does --.

Column 2,
Line 1, “grip that was” should read -- grip was --.
Line 4, “Overlapping Grip” should read -- overlapping grip --.
Line 43, “mirrors images” should read -- mirror images --.

Column 4,
Line 15, “hand 304” should read -- hand 302 --.

Signed and Sealed this

Fourteenth Day of December, 2004

JON W. DUDAS
*Director of the United States Patent and Trademark Office*